US005085357A

United States Patent [19]

Chen

[11] Patent Number: 5,085,357

[45] Date of Patent: Feb. 4, 1992

[54] COLLAPSIBLE GARMENT HANGER WITH HOOK RECESS

[76] Inventor: Ken-Wang Chen, 50, Lane 274, Chung Cheng S. Rd., Yang Kang Hsiang, Tainan Hsien, Taiwan

[21] Appl. No.: 686,399

[22] Filed: Apr. 17, 1991

[51] Int. Cl.[5] ..... A47G 25/40; A47G 25/14

[52] U.S. Cl. ..... 223/89; 223/94; 223/DIG. 4; 223/92; 223/85; D6/315; D6/324

[58] Field of Search ..... 223/89, 94, 92, DIG. 4, 223/85, 88; D6/315, 318, 324

[56] References Cited

U.S. PATENT DOCUMENTS

| | | | |
|---|---|---|---|
| 2,366,533 | 1/1945 | Kahn | 223/92 X |
| 2,425,527 | 8/1947 | Gaudino | 223/94 |
| 2,519,276 | 8/1950 | Needles et al. | 223/89 X |
| 4,168,791 | 9/1979 | Clark, Jr. | 223/94 |
| 4,905,877 | 3/1990 | Gatling | 223/94 X |
| 4,932,571 | 6/1990 | Blanchard | 223/94 X |
| 4,997,115 | 3/1991 | Jolley | 223/94 X |
| 5,007,562 | 4/1991 | Brink et al. | 223/94 X |

FOREIGN PATENT DOCUMENTS

| | | | |
|---|---|---|---|
| 66850 | 10/1943 | Norway | 223/89 |
| 42950 | 9/1916 | Sweden | 223/94 |

*Primary Examiner*—Werner H. Schroeder
*Assistant Examiner*—Bibhu Mohanty
*Attorney, Agent, or Firm*—Morton J. Rosenberg; David I. Klein

[57] ABSTRACT

A foldable hanger of the present invention mainly comprises a hook portion, a frame and two shoulders. The hook portion is formed with an extended cylindrical post at its lower portion, from which extends a notch from half way of the cylindrical post down to its bottom, and two flanges at its two sides of the notch. The frame has an upper and a lower hollow pipes with a board formed inbetween the two pipes. Both of the upper and the lower pipes have teeth integrally formed in the hollow bodies and a block ring placed inside of each end of the two pipes. The board is integrally formed with the two pipes having a recess being shaped like the hook in reversed position located underneath the cut portion of the upper pipe each of which has two flat plates extended upwardly from the cut ends therefrom and each of which further has two semi-circle plates extended outwardly from the top of the flat plate towards the two ends of the upper pipe respectively. The two shouldes are shaped like an English Capital letter 'U' with each end formed with an elastic stopper and a notch. The stoppers are to engage with the teeth of the upper and the lower pipes by placing the stoppers in a pitch of the teeth so that shoulders are fixed in position. By pushing the two shoulders inwardly, the elastic stoppers will be squeezed backward and the two shoulders 3 can move towards the center of the pipes and by folding the hook portion downwardly into the recess of the board, the hanger is folded in a small size which takes less space that prior or art.

2 Claims, 6 Drawing Sheets

COLLAPSIBLE GARMENT HANGER WITH HOOK RECESS

BACKGROUND OF THE INVENTION

Hangers of prior of art are mostly integrally formed into a triangle shaped frame with a hook portion located above of the frame for the convenience in hanging clothes in order to keep them in shape. However, since they are integrally formed, their size is fixed and can not be changed. Therefore, when travelling in a long way, people sometimes need to bring one or two formal suits with them to meet their clients or take part in a party and it is necessary to bring hangers to hang their suits to keep them in shape. In doing this people need to bring hangers with them and they find out that hangers take a lot of space in their luggage.

In view of this, the inventor has invented a foldable hanger which takes less space of storage.

SUMMARY OF THE INVENTION

It is the primary object of the present invention to provide a foldable hanger which has a hook portion and two shoulders that can be folded or drawn back to save storage space.

It is another object of the present invention to provide a foldable hanger which is easy to carry.

It is still another object of the present invention to provide a foldable hanger which is easy to operate.

It is a further object of the present invention to provide a foldable hanger which is inexpensive to produce.

DETAILED DESCRIPTION OF THE PREFERRED EMBODIMENT

Figures 1A, 1B:
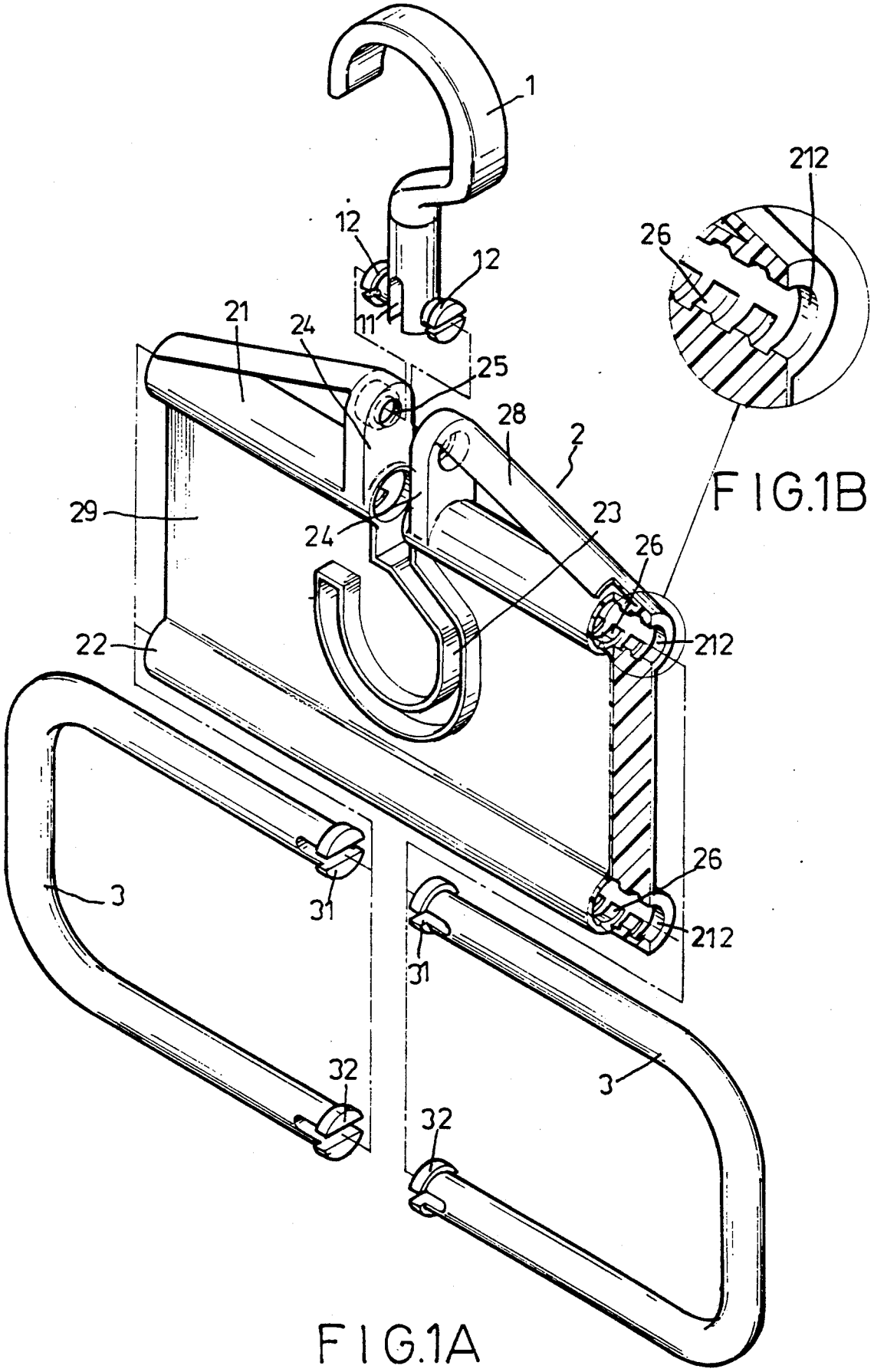
FIG. 1A is a fragmentary view o f the present invention.
FIG. 1B is an enlarge view of the teeth of FIG. 1A.

Reference is now made to FIG. 1A which shows the present invention comprises a hook portion 1, a frame 2 and two shoulders 3. The hook portion 1 has a cylindrical post extended downwardly and has a notch 11 extends half way of the cylindrical post down to the bottom and two flanges 12 at the two sides of the notch 11. The frame 2 has an upper pipe 21, a lower pipe 22 and a board 29. The upper pipe 21 has its center part cut out a portion and extends two flat plates 24 from the center ends of the upper pipe 21 therefrom upwardly with one at each end. Each of the flat plates 24 has a hole 25 and extends a support outwardly from its top therefrom toward each end of the upper pipe 21. The board 29 has a recess 23 extends from the center of the upper pipe 21 where the two flat plates 24 are located downwardly and is shaped like the hook 1 in a reversed position. Inside of the upper and the lower pipes 21 and 22, there are teeth 26 regularily formed and a block ring 212 at each inner end (shown as in FIG. 1B). The two shoulders 3 are shaped like an English Capital letter 'U' and have elastic stoppers 31 and notches 32 at each end.

Figure 2:
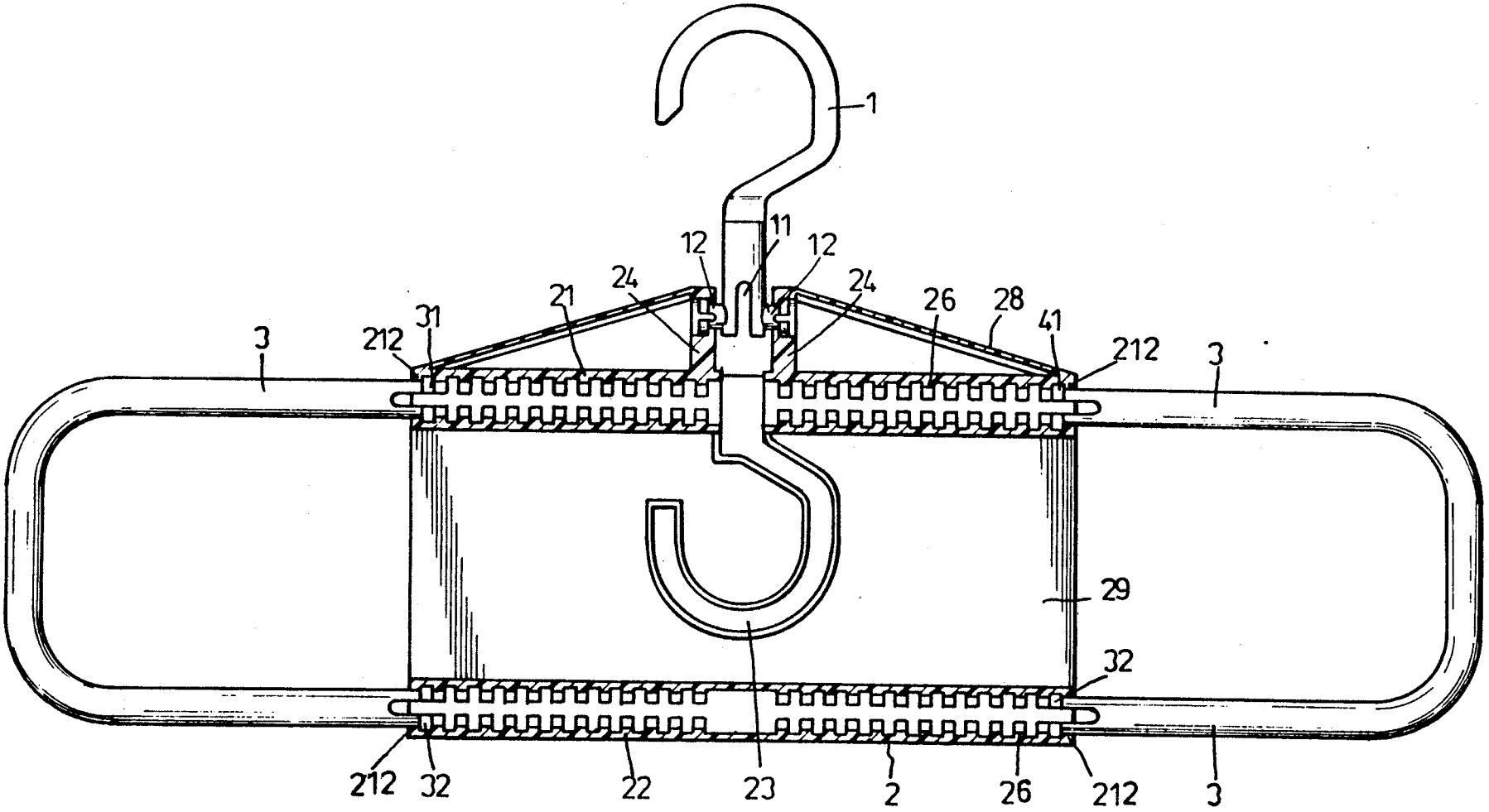
FIG. 2 is a cross sectional view of FIG. 1 shown in normal position.

Reference is now made to FIG. 2 which shows the two shoulders 3 are inserted into the two pipes 21 and 22 with their elastic stoppers 31 located in the pitch between the stop ring and the first tooth. The hanger is, therefore, ready for use. The two shoulders 3 may even be adjusted to fit clothes with different sizes. For instance, if the hanger is for adult's clothes, the two shoulders 3 may be pulled outwardly until the width fits the width of the clothes and the shoulders 3 may be pushed inwardly to fit the width of babies' clothes. By pushing the two shoulders 3 towards the board's direction, the elastic stoppers 31 at each end will be squeezed and forced to pass through each tooth, and the pushing force may be stopped at the place where the length is most desired.

Figure 3:
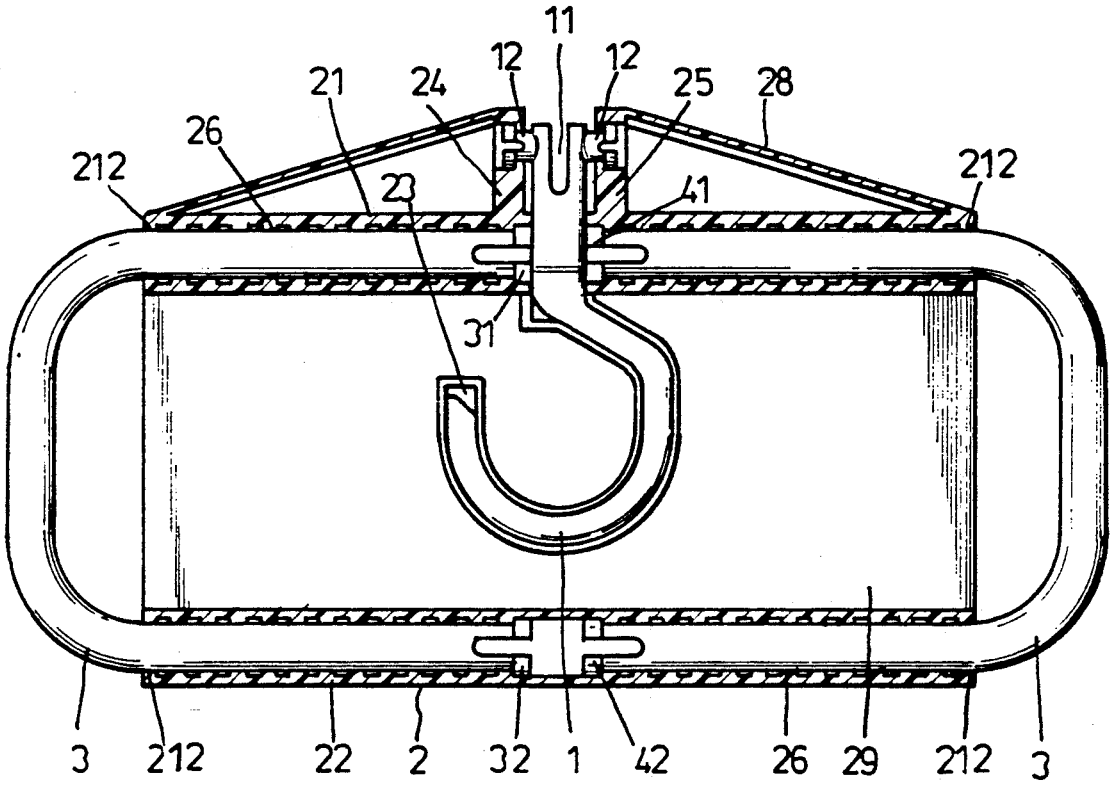
FIG. 3 is another cross sectional view of FIG. 1 shown in a folded position.
Figure 4:
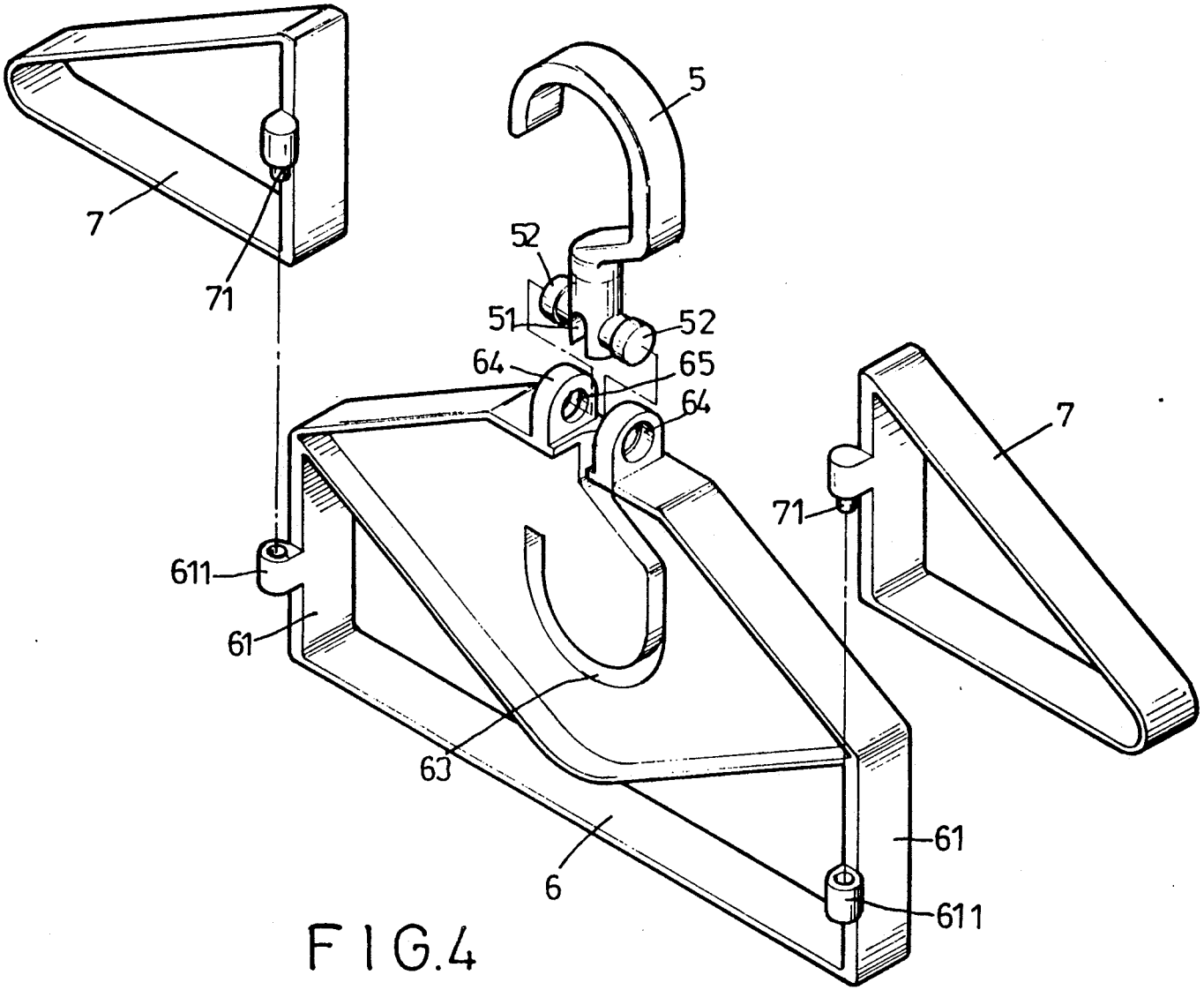
FIG. 4 is another fragmentary view of the present invention in another aspect.

FIG. 4 shows a fragmentary view of the present invention in another design which also comprises a hook portion 5, a frame 6, and two shoulders 7. The hook portion 5 is shaped like the one mentioned above in FIGS. 1 to 3 having a cylindrical post with a notch 51 and two flanges 52. The frame 6 has a minor differences from the other one that the frame 6 has being partitioned into two portions with the upper portion having a recess 63 shaped like the hook portion 5 in reversed position and a twin-triangle 61 being shaped like the two shoulders 7 at the lower portion. The frame 6 also has two hinge joints 611 at two sides of the frame 6 to accept two hinges 71 which are integrally formed with the two shoulders 7.

Figure 5:
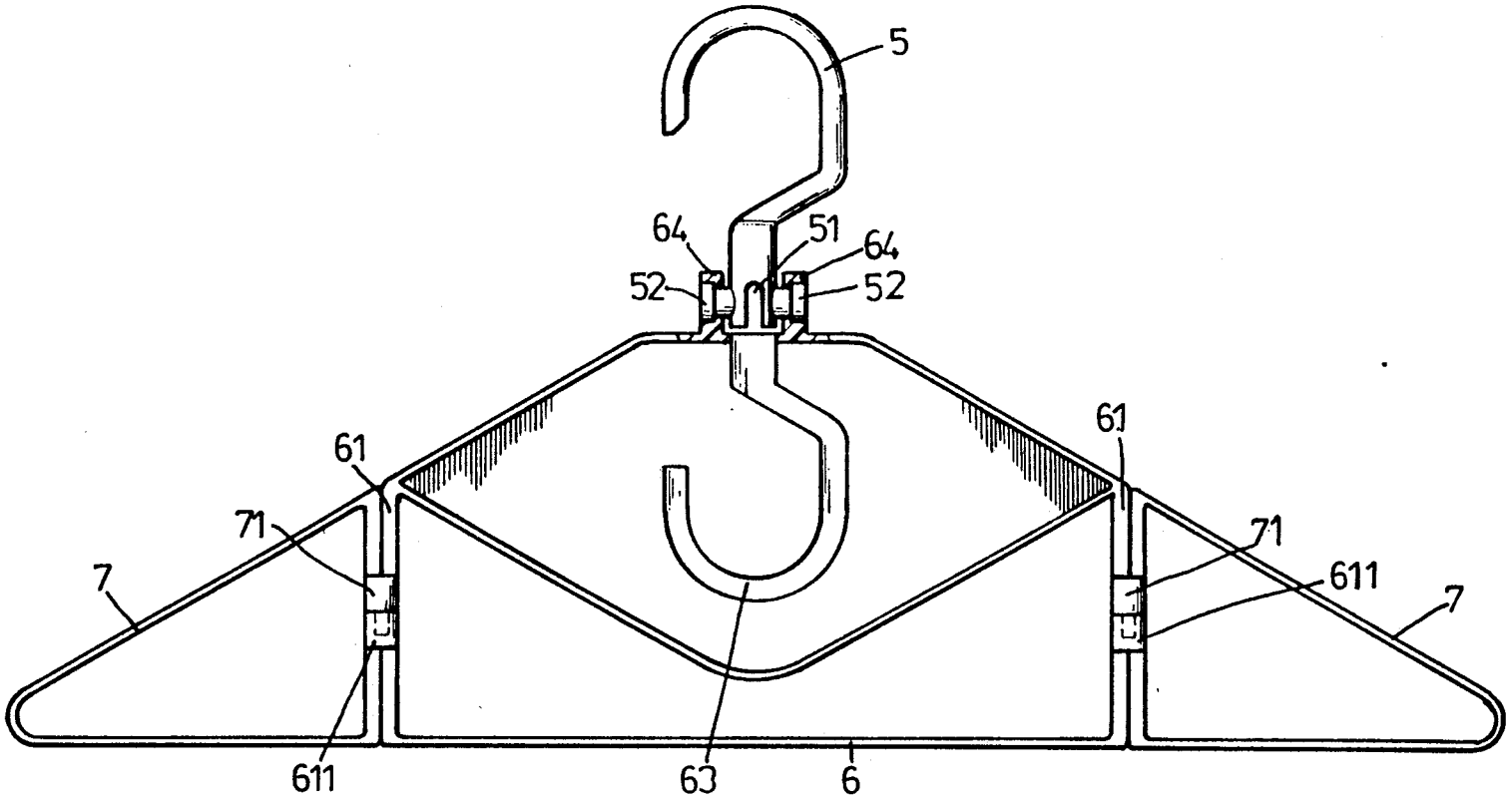
FIG. 5 is a perspective of FIG. 4 shown in a normal position.

FIG. 5 shows a perspective view of FIG. 4 which has being installed and ready to be used.

Figure 6:
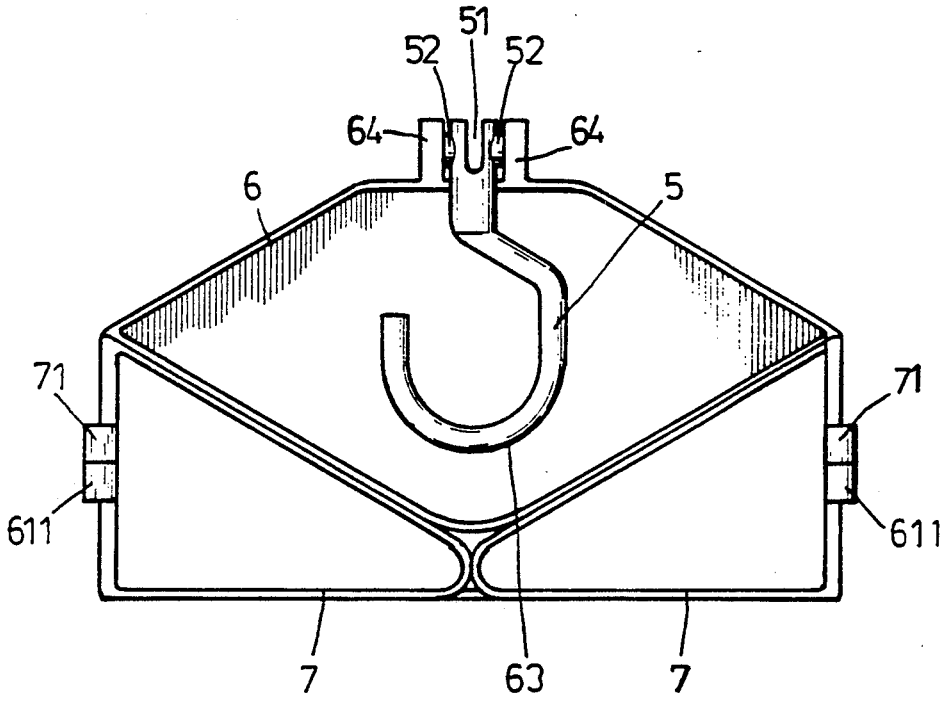
FIG. 6 is another perspective of FIG. 4 shown in a folded position.

FIG. 6 has shown the two shoulders 7 being folded into the twin-triangle 61 and the hook portion 5 has being folded down into the recess 63.

I claim:

1. A foldable garment hanger comprising:

a hook portion and a cylindrical post being extended downwardly from said hook portion with a notch being formed in the lower half of said cylindrical post and two flanges connected to sides of said notch;

a frame having an upper and a lower hollow pipe and a board being formed inbetween said pipes; said upper pipe has its center portion cut off and at each cut end of said upper pipe extends a flat plate raised upwardly; each of said flat plates has a hole and extends to a support from the top of the plate down to the outer end of said upper pipes; said board has a recess being shaped like said hook in a reversed position; said upper and lower pipes have teeth being serially formed inside and a block ring being located at each inner end of said pipes;

two U-shaped shoulders having an elastic stopper and a notch at each end to engage with said teeth of said two pipes; wherein further said each flange engages one of holes in said 7 plates.

2. A foldable garment hanger comprising:

a hook portion and a cylindrical post being extended therefrom with a notch extended half way up bottom of said cylindrical post and two flanges connected to sides of said notch;

a frame being partitioned into at least two portions with a upper board portion having a recess being shaped like a reversed position of said hook portion with the lower portion being shaped to a twin-triangle shape and having two hinge joint at two sides of said frame;

two shoulders with a hinge at each side of said two shoulders connected to said one of said hinge joints.

* * * * *